United States Patent [19]

Weir

[11] Patent Number: 4,825,605

[45] Date of Patent: May 2, 1989

[54] CLOSURE DEVICE FOR WALL OPENING

[75] Inventor: Donald H. Weir, York, Pa.

[73] Assignee: Wexco Incorporated, York, Pa.

[21] Appl. No.: 142,989

[22] Filed: Jan. 12, 1988

[51] Int. Cl.[4] ..... E04H 3/16

[52] U.S. Cl. ..... 52/169.7; 52/302; 52/303; 52/514; 4/506

[58] Field of Search ..... 52/169.1, 169.7, 169.8, 52/302, 303, 514; 4/506, 507, 488, 494

[56] References Cited

U.S. PATENT DOCUMENTS

| | | | |
|---|---|---|---|
| 3,555,575 | 1/1971 | Schwarz et al. | 52/169.7 X |
| 3,831,897 | 8/1974 | Stegmeirer | 4/507 |
| 4,124,907 | 11/1978 | Laven | 52/169.1 X |
| 4,193,243 | 3/1980 | Tiner | 52/514 |
| 4,281,422 | 8/1981 | Simonelli | 4/507 X |
| 4,297,823 | 11/1981 | Keisler | 52/514 |
| 4,301,629 | 11/1981 | Farr | 52/302 X |
| 4,343,118 | 8/1982 | Lankheet | 52/169.7 |
| 4,358,495 | 11/1982 | Parker | 52/514 X |
| 4,460,420 | 7/1984 | Estrada | 52/514 X |

*Primary Examiner*—David A. Scherbel
*Assistant Examiner*—Richard E. Chilcot, Jr.
*Attorney, Agent, or Firm*—Arthur J. Plantamura

[57] ABSTRACT

An arrangement to close an unwanted opening in wall is provided wherein the area of the opening when it has been plugged presents a surface which is flush with the face of the wall.

The opening closure system provided permits the use of otherwise surplus unusable modular wall panels to be converted to plain panels that are readily integrated into a swimming pool wall structure. The closure plugs are formed so as to have a dual wall thickness; a central portion having an area co-extensive with the area of the opening to be plugged and a peripheral "frame" portion of a lesser thickness which abuts against the back of the panel portion which frames the opening in the panel. Teeth or mounting screw hole filling protuberance may be integrally formed on the peripheral portion of the closure plug to fill screw or fastener holes present in the wall contiguous to the opening which is to be closed.

11 Claims, 2 Drawing Sheets

CLOSURE DEVICE FOR WALL OPENING

The present invention relates to a closure device for a wall opening and, more particularly, to an element for modifying swimming pool modular wall panels that are provided with an access opening therein. The invention enhances the versatility of modular wall panels, that have a preformed opening therein, and permits the application of such panels to a use in addition to the primary use for which the panel was manufactured.

BACKGROUND OF THE INVENTION

Swimming pools, conventionally shipped as a unitary package, include in the package all the necessary wall panels and braces to build that specific pool model. Included with the pool wall (usually steel) panel assortment for the swimming pool side wall structure, are plain panels (without holes), wall fitting (W/F)panels, and skimmer and other panels into which fixtures are inserted. Several wall panels in the pack are provided with openings, such as a rectangular opening for a skimmer, a pool water return opening, etc. Also, there are light panels which may be special ordered. Here again, a pre-formed access opening is provided in the panel so that a light fixture may be inserted.

Sometimes these swimming pool wall panels having openings there are not used for the purpose intended. For example, when a builder uses a stair module in the pool, he has an extra wall panel which he stores. When he uses a light panel, he substitutes the light panel for another wall panel in the pack. Sometimes a builder orders one size pool and builds a pool of a different size. The net effect is that he accumulates extra panels and in time has enough for the walls of a swimming pool.

There are times when a builder will want to use "left over" panels with holes as a plain (solid faced) panel. The Wall fitting/filler plug system provided in accordance with the invention plugs these holes so that the panels with openings preformed therein function as plain panels. If these openings in the panel are not plugged and an attempt is made to use these panels as plain (solid faced) panels, the liner would be drawn into the opening, due to the pressure of water, and would eventually tear. Additionally, when not properly plugged the resulting remaining depressions in the wall are visually apparent through the liner and are unsightly. The plugging system of the invention is devised so that the closure plug is inserted into the opening from the rear of the panel and attached by suitably reliable securing means such as with a permanent bonding adhesive. The face of plug is then flush with the face of panel. The thick and larger dimensioned part of plug engage rear of panel, allowing the smaller dimensioned part of plug to fit into hole. The result is a plain (solid smooth faced) panel.

By using the filler plugs a builder can convert a standard pool pack to one or more different pools just by using two wall fitting (W/F) filler plugs and one skimmer filler plug to change the W/F and skimmer panels which are in the standard pack into solid plain panels.

This capability of converting a panel, from one with an opening to a plain panel, afforded by the closure system of the invention, offers several advantages including:

Flexibility to the manufacturer and the builder in using panels; it allows the manufacturer and builder to store essentially only standard pool packs in inventory for use with standard filtration systems with the closure plug being used to convert a standard pool pack (panels with openings), by use of filler plugs, into panels for another and different configured pool; it provides cost and time savings associated with material use inventory reduction; and it permits rehabilitation of existing swimming pools in which plumbing line openings or accessory openings are to be relocated.

It is thus apparent that there is a need for means to modify swimming pool modular wall panels so as to permit the use of these panels in an application different from, and in addition to, the specific application for which such panels are manufactured.

SUMMARY OF THE INVENTION

It is accordingly an object of the invention to provide a method to modify a swimming pool modular wall panel which has been specifically manufactured with openings to accommodate specific fixtures by means permitting the use of the panel for general pool wall utility.

It is another and more specific object of the invention to provide means to close fixture openings in a swimming pool wall panel so that such wall panel will be suitable for use as a general utility or "plain" panel.

It is a further object of the invention to seal an opening in a swimming pool wall panel over which a liner is placed in a manner that is secure and substantially obviates unsightly indentations in the liner when water pressure is applied on the in situ liner.

It is another and more specific object to provide a novel plug or closure plate for a plumbing line access or an accessory opening in a modular swimming pool wall panel so as to present a flush, substantially uninterrupted, panel wall surface in the area where the opening has been closed. The plug may, optionally, include extension "teeth" or protuberances to close also the mounting holes for the accessory screws or other fasteners that are contiguous to the opening to be sealed.

These and other objects of the invention will become apparent from the following description and the accompanying drawing.

BRIEF DESCRIPTIONOF THE DRAWING

DESCRIPTION OF THE PREFERRED EMBODIMENT

Figure 1:
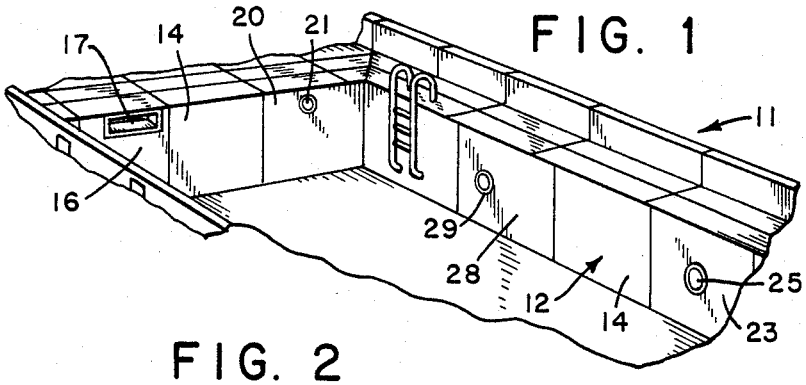
FIG. 1 is a fragmentary view showing a swimming pool comprised of modular wall panels and showing openings in some of the wall panels to accomodate fixtures.

The advantages of the invention will be more fully understood by reference to the drawing in conjunction with the following detailed description.

Referring to FIG. 1 of the drawing, a fragmentary portion of a swimming pool 11 formed from a plurality of modular wall panels is illustrated. The pool wall 12 comprises an assemblage of modular sections or panels which include, for example, plain panels 14 and panels adapted to receive a variety of fixtures therein such as ,for example, a panel 16 with an opening 17 to accomodate a skimmer in the opening; a panel 20 with an opening 21 to accomodate a water return; a panel 23 with an opening 25 to accomodate an underwater light; a panel 28 with an opening 29 to accomodate an underwater observation window; and the like.

In the construction of swimming pools a manufacturer will normally order and stock "typical" or standard pool packages which are supplied in packs or kits to a builder and which contain sufficient panels, including a set number of the special panels to accomodate the required standard fixtures.

For example, when a builder uses stairs (rather than a ladder) in the pool the builder is left with an excess panel which he may store with the expectation of possible future use. Also, when the builder installs a light, a special light panel is used in substitution for a standard (plain) panel that is contained in the pack. Also, sometimes a builder orders one size pool and finds that he is required to build a pool of a different size or configuration. The net effect is that the builder, invariably, accumulates extra panels and, in time, has a quantity of these "unused" panels which represent a considerable value and, if discarded, involve a substantial monetary loss.

In the past, builders have at times used, or attempted to convert to use these "left over" panels, usually with unsatisfactory results; both the effort to make use of these leftover panels and the end result when an attempt has been made to use them has been wanting.

Generally, in an effort to use these "left over" panels, with holes formed therein, the builder will try to use them as plain (solid faced) panels. The objective when using a leftover panel, having an opening therein, is to close the opening so that the panel may function suitably as plain panel. If the opening is not properly, and with a flush surfacewith the surface of the panel wall, an attempt to use these panels as plain (solid faced) panels results in the liner being depressed into the opening (due to pressure of water) giving an unsightly appearance. Moreover, failure to have a smooth flush surface results in eventual abrasion and tearing of the liner.

In accordance with the invention, a reliable and efficient means is provided to effectively close openings in the "unused" or "left over" panels in a manner which is not only efficient, and economical, but more importantly, converts such panels into fully acceptable modular units which do not suffer from the unsightly appearance and unsatisfactory performance that normally resulted from known prior efforts to make use of these "orphan" panels.

In accomplishing the purpose of the invention, closure elements comprising flat plug members having a "step", or a two thickness, configuration are provided with front portion or face area facing into the pool coextensive with the area of the opening to be closed and a rear portion, which may be integrally formed with the face portion, having a greater area than the face portion and formed so that the face of the rear (flange) portion abuts against that rear portion of the panel that frames or is peripheral to the opening in the panel. The rear portion of the plug may optionally contain integrally formed protrusions or teeth that extend from the rear portion to the plane of the face portion. These "teeth" fit into and close mounting screw holes that are contiguous to the opening and are used to secure the accessory in the wall opening. The plug is inserted from the rear of the panel and suitably attached, preferably by an adhesive. The face area of the plug, usually the thicker part, is flush with the face of panel. The end of any teeth present, and which fill the contiguous mounting screw holes, is also flush with the face of the panel. The larger dimensioned (flange) part of plug engages the rear of the panel, allowing the smaller dimensioned part of plug, as well as any peripheral (mounting screw hole) teeth, to fit, i.e., extend into the openings. The result is a plain (solid faced) panel which in performance and appearance is essentially the equal of a plain panel in which no opening has been formed.

Figure 2:
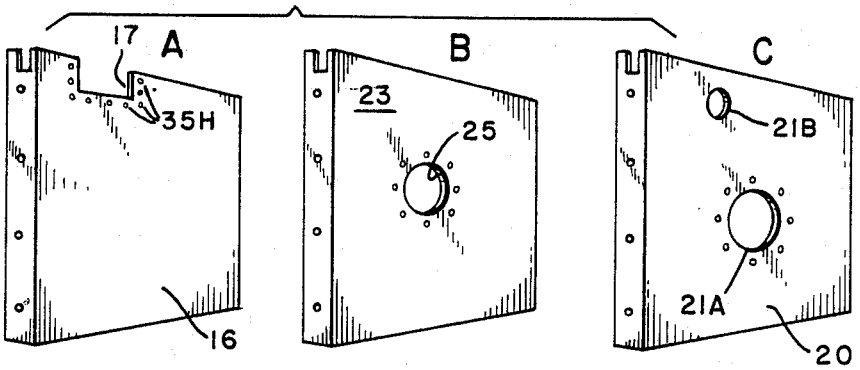
FIGS. 2A, 2B and 2C illustrate in perspective views individual swimming pool modular wall panels with fixture openings of varying sizes and dimensions.
Figure 3:
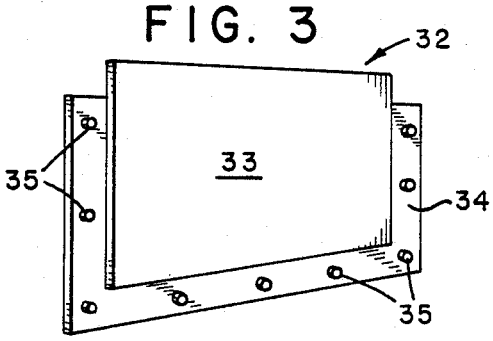
FIG. 3 is a perspective view of the closure element of the invention having a generally rectangular configuration and adapted typically to close a wall skimmer opening.

As seen by reference to FIG. 2–7 of the drawing when a panel, such as that shown as 16 in FIG. 2A, having a skimmer opening 17 is left over or unused for any reason, it may readily be converted to a plain modular panel by securing a plug 32 into the opening so that the thicker or face part 33 (see FIG. 7) of the plug, i.e., the central smaller area which is dimensioned to fill the opening 17, is inserted into the opening. Similarly, when integrally formed mounting screw filler protuberances 35 are present on the closure element of the invention, these fit into and fill the screw mounting holes 35H that are present contiguous to the wall opening. The plug is dimensioned so that the thickness or depth of the plug 32, and the teeth or protuberances 35, from the face 33 to the backing extension or flange 34, which substantially "frames" the face portion 33, is essentially the thickness of the wall panel 16. Thus when in position so that the flange portion 34 abuts against the peripheral portion of the back of the wall panel which frames the opening 17, the face 33, or central smaller area of the plug and the ends of the protuberances 35, are flush with the interior surface of the panel 16 and presents a substantially smooth uninterrupted face against which a pool liner may rest without distortion or wrinkling. The wall with the plug positioned so as to seal the opening is shown in assembled view in FIGS. 6 and 7.

Shown in FIG. 2C is a wall panel provided with an opening 21B for a water return to the swimming pool as is conventional in a standard filtration system. A second opening 21A of a larger size is also illustrated in FIG. 2C of a kind that might be used for an underwater light accessory, for example. Should the pool configuration be modified or adapted to a filtration scheme, such as that disclosed in U.S. Pat. No. 4,661,247 in which the filtraion system and required panel openings are different, a panel 20 having an opening 21B, of the kind such as that illustrated at FIG. 2C, would be surplus. To adapt what might be considered a surplus panel of this kind for use as a plain panel, a plug such as that illustrated at 36B in FIG. 5B would be secured in the opening 21B so that face portion 37B would be flush with the inside face of the panel 20; the recessed frame or flange portion 38B would abut against the back portion of panel 20 which frames the opening 21B With respect to the larger opening in panel 20, the circular plug 36A would be similarly fitted and sealed in place in the opening 21A with the face portion 37A and the ends of the screw filling protuberances or teeth 39A being flush with the inside face of the panel 20.

Figure 4:
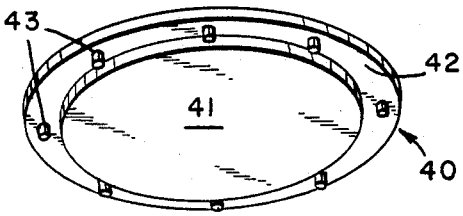
FIG. 4 is a perspective view of still another configuration for a wall panel closure element of the invention having a generally oval configuration.
Figure 5:
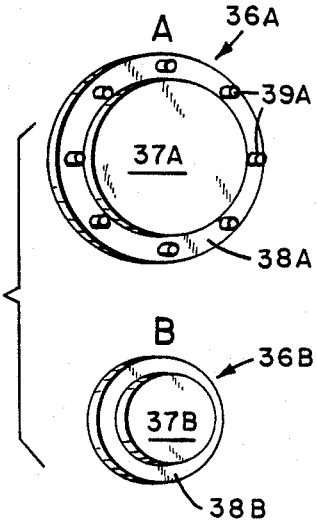
FIGS. 5A and 5B are perspective views of an alternative closure element or plug for the opening in accordance with the invention showing closure plugs of two sizes and having a generally circular configuration.
Figure 6:
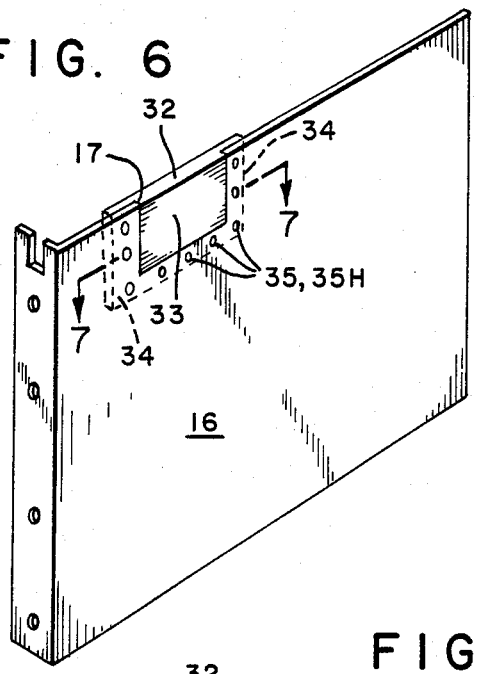
FIG. 6 is a perspective view of a skimmer adapting panel with skimmer opening that has been closed with a corresponding plug.
Figure 7:
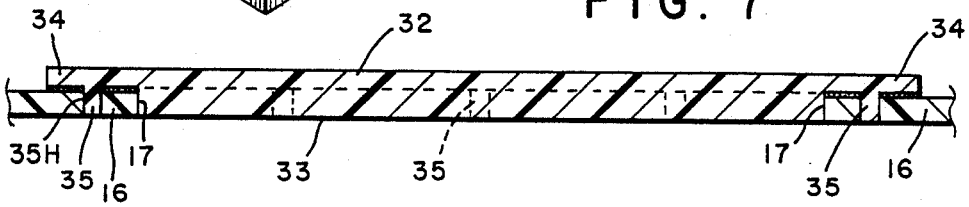
FIG. 7 is a view taken along line 7—7 of FIG. 6.

Similarly, with reference to FIGS. 2B and 4, when the panel 23 with an opening 25 having an oval configuration and which, may accommodate a viewing window, for example, is not used and the panel 23 is "excess" because of an unwanted opening therein, a plug such as that shown as 40 in FIG. 4 is secured from the back of panel 23 so that the face 41 of plug 40 fills the opening 25 and the surface of face 41 is flush with the surface of the panel which faces inside the swimming pool and against which the pool liner is backed. The flange or peripheral "frame" portion 42 of the plug 40 abuts against the portion of the back of panel 23 which is contiguous or peripheral to the opening 25. Screw mounting hole filler protuberances 43 are formed with the extremity face (of these protuberances) also flush with the face of the panel 23.

Figure 8:
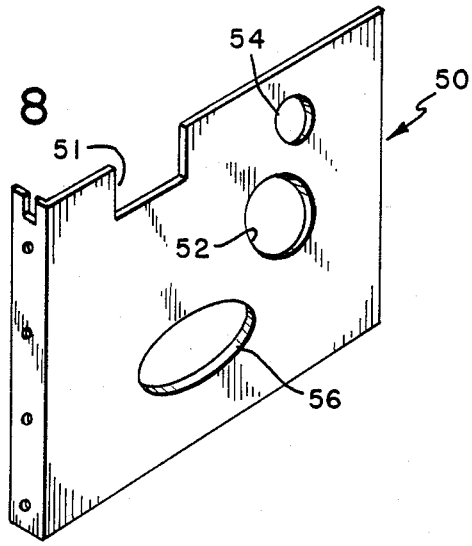
FIG. 8 is aperspective view of a typical "general purpose" panel, with various openings formed in the panel being and adaptable to selectively accomodate various accessories.

As a further advantageous capability of the system of the invention, a panel may be supplied so as to have a plurality of openings with corresponding filler plugs to accommodate different fixtures, alternatively, such that only the opening for the fixture of choice is left open while the plugs supplied with the panel are used to close the openings which are not to be used. A typical multi-opening of panel 56 of this kind is illustrated in FIG. 8 in which larger and smaller circular openings 52 and 14 respectively, which may be plugged with closure element of conforming size of the kind shown in FIG. 6 and an oval opening 56 plugged with a closure element of the kind shown in FIG. 7. A panel of this kind will afford greater versatility to the pool pack stocked by the dealer and requiring only a set of plugs which are relative inexpensive and nonbulky to stock. Mounting screw holes and filler(teeth) elements for the holes, as described, for example, with reference to FIGS. 2A and 3, may be provided.

It is thus seen that by using the plug closure system of the invention, a swimming pool builder can easily convert a standard pool pack so that it is usable with a swimming pool such as that of U.S. Pat. No. 4,661,247, for example, by using two wall filling filler plugs and one skimer filler plug to change the wall filling and skimmer panels which are in the standard pack into solid plain panels.

The invention, it is seen, affords various advantages including:

1. The manufacturer, as well as the builder, is afforded more flexability in using panels.
2. The manufacturer and builder need store only standard pool packs in inventory for use with standard filtration systems; the hole plugging system of the invention enables the builder to convert a standard pool pack to various alternative swimming pool configurations. This permits the construction of different configured pools with minimal inventory and without material, i.e., without panel loss.
3. Considerable cost and time savings are obtainable as a result of the added flexibility with existing limited inventory since the extent of "special orders" for varying swimming pool designs and accessory options is substantially reduced.
4. The rehabilitation of a detiorated swimming pool is facilitated and the cost is reduced where, for example, the old plumbing lines or existing accessories must be relocated or removed and the pre-existing wall openings sealed.

The closure plug or plate of the invention is preferably formed of a synthetic resinous composition. A resinous composition is often the material of construction also for the swimming pool modular wall panel. Suitable resinous compositions include such material as polyolefin or a polycarbonate, or resinous composition blends, such as styrene butadiene, and the like. It will be apparent that other materials of constructions may be suitably used in forming the closure plug, such as, sheet metal, treated wood or wood laminate, fiberglass or various composite materials, e.g., ceramics, and the like.

The closure plug element of the invention may be secured to the panel by adhesive, spot welding, solvent bonding or otherwise securely fastened to the flange portion. Preferably the plug is secured with a suitable adhesive, which may comprise a self sticking composition.

The sealed opening should provide a substantially smooth face at the interior surface. In the case of a swimming pool especially, the closure plug is "tailored" to present a smooth gap free surface which minimizes indentations, burrs or other imperfections which often characterized prior crude attempts to close pre-existing wall opening and which tend to snag or crease or tear the plastic pool liner that is pressed against the wall surface.

It will be apparent from the foregoing description and within the concept of the closure system of the invention, that many modifications and variations in details of the present invention may be made. It is, therefore, to be understood that the invention, except as particularly required by the limitations expressly recited in the claims, should not be limited to the details set forth which have been provided primarily to aid in a better understanding of the inventive concept.

What is claimed is:

1. A method of closing a preformed access opening in a swimming pool, wall member so as to present a substantially uninterrupted front wall surface area over the entire opening; the method comprising:

(a) inserting into the opening present in the wall member, a closure element, said closure element having integrally formed construction and including a front face first portion having a relatively smaller face area coextensive with the area of an opening to be closed and a flange second portion with a relatively larger area and having a front face of the flange set back from the face of the first portion a distance substantially equal to the thickness of the wall panel at a point contiguous to the access opening;

(b) inserting the face of the closure element through the wall opening from the rear of the wall whereby the face of the flange portion abuts against the back part of the panel which is peripherally contiguous to the opening and the face of the first portion is coplanar with the face of the wall; and (c) securing the closure element at the face of the flange portion and against the back of that part of the wall which is peripheral to the opening.

2. The method of claim 1 wherein the the closure element comprises a synthetic resinous composition.

3. The method of claim 1 wherein the closure element is secured at the face of the flange portion with an adhesive that is compatible with the surfaces to be joined.

4. The method of claim 1 wherein the wall member comprises a panel and mounting screw holes are formed contiguous to the access opening and the face of the flange portion of the closure element is provided with extending teeth conforming in size to said mounting screw openings to close said fastener openings when the closure element in secured in the panel opening.

5. A closure device for securing to a swimming pool, wall panel to plug an access opening in the panel and so as to present a substantially flush uninterrupted surface across the acess opening comprising;

a substantially flat closure plug integrally formed so as to be provided with (a) a first front face portion comprising a face portion that is relatively smaller in area and devised to fit within, and have an area that is substantially coextensive with the area of said access opening to be plugged, and (b) a second peripheral flange portion larger in dimensional area than the face portion and whose face is set back, from the face of the first porportion, a distance substantially equal to a thickness of a panel contiguous to the opening therein, such that the face of the relatively smaller face portion extends through an opening a distance sufficient to present the surface plane of the first face portion substantially coplanar with a surface plane of a panel in which the closure device has been installed.

6. The device of claim 5 which is formed of a plastic composition.

7. The device of claim 5 in which the front face of the peripheral flange is provided with a self sticking adhesive.

8. The device of claim 5 in which the peripheral flange is adapted to be spot welded.

9. The device of claim 5 wherein the peripheral flange is provided with integrally formed spaced teeth that are adapted to fill fastener holes present in a panel contiguous to the access opening which is to be pluggedby said closure device.

10. The closure device of claim 9 which comprises a unit that is integrally formed from a synthetic resinous composition.

11. The closure device of claim 7 which comprises a unit that is integrally formed from a synthetic resinous composition.

* * * * *